US009933238B1

(12) United States Patent
Campbell

(10) Patent No.: US 9,933,238 B1
(45) Date of Patent: Apr. 3, 2018

(54) BLEED OUT ARROW

(71) Applicant: Sean Campbell, Tulsa, OK (US)

(72) Inventor: Sean Campbell, Tulsa, OK (US)

( * ) Notice: Subject to any disclaimer, the term of this patent is extended or adjusted under 35 U.S.C. 154(b) by 0 days.

(21) Appl. No.: 15/627,564

(22) Filed: Jun. 20, 2017

Related U.S. Application Data

(60) Provisional application No. 62/372,414, filed on Aug. 9, 2016.

(51) Int. Cl.
*F42B 6/04* (2006.01)
*F42B 12/36* (2006.01)

(52) U.S. Cl.
CPC ..... *F42B 6/04* (2013.01); *F42B 12/362* (2013.01)

(58) Field of Classification Search
CPC ..... F42B 12/362; F42B 6/04
See application file for complete search history.

(56) References Cited

U.S. PATENT DOCUMENTS

| | | | | |
|---|---|---|---|---|
| 2,554,012 | A | 5/1951 | Cohen | |
| 3,617,060 | A * | 11/1971 | Iezzi | F42B 6/04 473/581 |
| 4,212,463 | A | 7/1980 | Repinski et al. | |
| 4,252,325 | A | 2/1981 | Weems et al. | |
| 6,238,310 | B1 | 5/2001 | Morrison | |
| 6,719,652 | B1 | 4/2004 | Rhodes, Jr. | |
| 7,935,012 | B2 | 5/2011 | Lee | |
| 8,784,242 | B2 | 7/2014 | Gendregske | |
| 2007/0225093 | A1 | 9/2007 | Kidwell | |

* cited by examiner

*Primary Examiner* — John Ricci
(74) *Attorney, Agent, or Firm* — Millikin McKay PLLC

(57) ABSTRACT

The present invention is a bleed out arrow that allows a wounded animal to bleed out and die more quickly. The arrow is provided with a hollow shaft with openings in it that serve as conduits for blood to exit the animal's body when the arrow has lodged in the wounded animal's body. The openings are in the form of slits that are located at the front end of the shaft just behind the blades of the arrow tip and aligned longitudinally with the blades of the arrow tip, at the rear end of the shaft just behind the fletches and aligned longitudinally with the fletches, and in the middle of the shaft, preferably behind the blades and preferably aligned longitudinally with the blades of the arrow tip.

6 Claims, 1 Drawing Sheet

BLEED OUT ARROW

CROSS-REFERENCE TO RELATED APPLICATIONS

The present application claims priority to U.S. Provisional Patent Application No. 62/372,414 for Bleed Out Arrow that was filed on Aug. 9, 2016.

BACKGROUND OF THE INVENTION

1. Field of the Invention

The present invention relates to an archery arrow that is designed to be a more humane way to kill an animal such as a deer by allowing the animal to bleed out and die more quickly once it has been shot with the arrow.

2. Description of the Related Art

Hunting animals with a bow and arrow poses some problems. One such problem is where an animal has been fatally wounded by being shot with an arrow, but due to the arrow remaining lodged in the wound, the animal does not bleed out and die quickly. This happens because the shaft of the arrow serves as a plug to seal the animal's wound and preventing the internal bleeding from exiting the wound. This keeps the blood inside the animal, and the wounded animal will often run several miles before it dies from its internal injuries.

Also, because the animal is not bleeding externally, it does not leave a trail of blood as it runs. Without a trail of blood to follow, it can be difficult for the hunter that shot the deer to track it and recover its body when the animal finally dies. If the hunter cannot track the animal, the animal will die and the hunter does not get the meat from the animal that he was seeking to obtain.

A more humane way of killing a deer is needed that allows the fatally wounded animal to bleed out more quickly, to die more quickly so that it does not travel as far after being wounded, and to leave a blood trail that a hunter can follow so that the hunter can recover the carcass for meat.

The present invention addresses this need by providing an arrow that is hollow and has openings in the form of slits at the front end just behind the blades and aligned longitudinally with the blades of the arrow tip, at the rear end just behind the fletches and aligned longitudinally with the fletches, and in the middle of the arrow, preferably behind the blades and aligned longitudinally with the blades of the arrow tip. The particular alignments serve to made the arrow more aerodynamic, allow the arrow to be shot in a more accurate trajectory, and reduce the noise created as the arrow flies through the air upon being released from the bow.

This arrow is designed to allow an animal to bleed out more quickly once it has been shot by the arrow and when the arrow remains lodged in the wounded animal. Being hollow, the arrow of the present invention serves as a conduit for the blood to exit the wound through the arrow. Openings in the form of slits in the arrow allow blood from within the animal's body to enter the hollow arrow and to flow through the arrow to other openings in the form of slits provided in the arrow that are located external to the animal's body.

SUMMARY OF THE INVENTION

The present invention is a bleed out arrow that has a hollow shaft that serves as a conduit for blood to allow an animal that has been shot with an arrow that lodges in the animal to bleed out and die more quickly. The arrow has openings in the form of slits at the front end just behind the blades of the arrow tip and aligned longitudinally with the blades of the arrow tip, at the rear end of the arrow just behind the fletches and aligned longitudinally with the fletches, and in the middle of the arrow, preferably behind the blades and preferably aligned longitudinally with the blades of the arrow tip. The particular alignments of the openings serve to made the arrow more aerodynamic, allow the arrow to be shot in a more accurate trajectory, and reduce the noise created as the arrow flies through the air upon being released from the bow.

DETAILED DESCRIPTION OF THE PREFERRED EMBODIMENT

Figure 1:
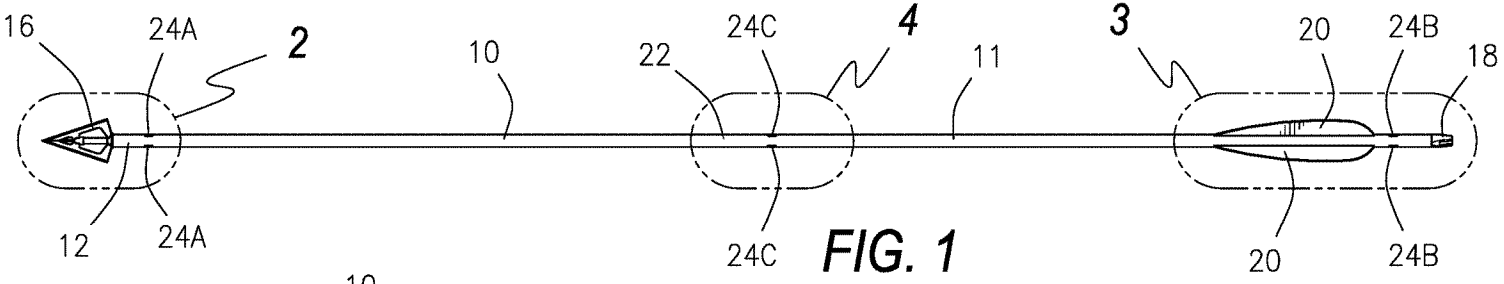
FIG. 1 is a perspective view of an arrow that is constructed in accordance with a preferred embodiment of the present invention.
Figure 3:
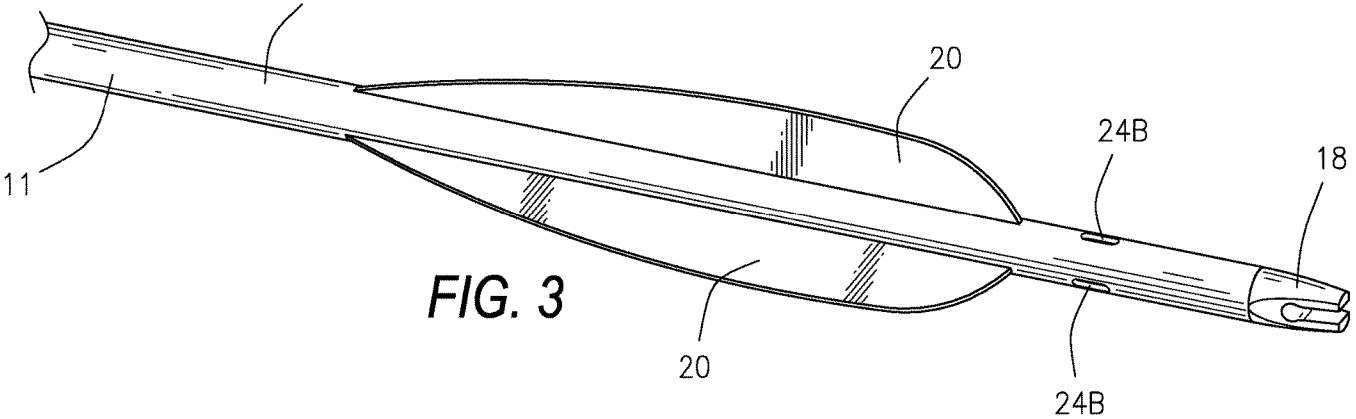
FIG. 3 is an enlarged view of the area within circle 3 of FIG. 1.
Figure 4:
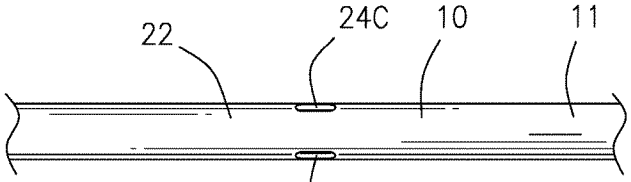
FIG. 4 is an enlarged view of the area within circle 4 of FIG. 1.
Figure 2:
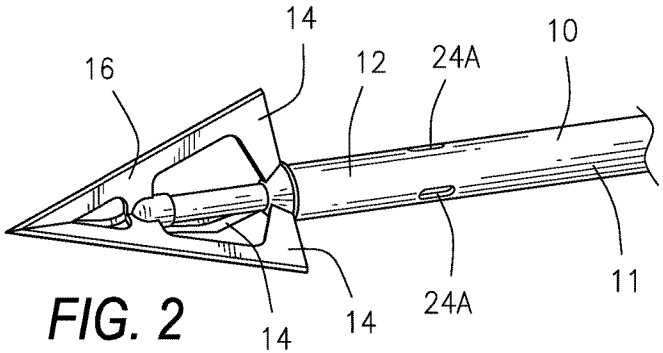
FIG. 2 is an enlarged view of the area within circle 2 of FIG. 1.

Referring now to FIGS. 1-4 of the drawings, there is illustrated a bleed out arrow 10 that has a shaft 11 that is hollow internally. The hollow arrow 10 serves as a conduit for blood to allow an animal to bleed out and die more quickly when the animal has been shot with the arrow 10 and the arrow 10 has lodged in the animal's body.

The arrow 10 has front openings 24A, preferably in the form of slits, at the front end 12 just behind the blades 14 of the arrow tip 16 and aligned longitudinally with the blades 14 of the arrow tip 16. The arrow 10 also has rear openings 24B, preferably in the form of slits, at the rear end 18 of the arrow 10 just behind fletches 20 that are aligned longitudinally with the fletches 20. Additionally, the arrow 10 has middle openings 24C, preferably in the form of slits, and in the middle 22 of the arrow 10. The middle openings 24C are preferably located behind the blades 14 and preferably aligned longitudinally with the blades 14 of the arrow tip 16.

The locations of the openings 24A, 24B and 24C relative to the blades 14 and fletches 20 are important to maintain stability of the arrow 10 as the arrow 10 travels through the air upon being fired. These locations also serve to reduce the "whistling" noise created as air passes over the openings 24A, 24B and 24C during flight of the arrow 10.

Likewise the configuration of the openings 24A, 24B and 24C as slits is important for stability of the arrow 10 and noise reduction. The slits 24A, 24B and 24C produce less wind noise when the arrow 10 is shot than a regular round hole would produce.

Also, the size of the openings 24A, 24B and 24C contributes to noise reduction and flight stability of the arrow 10. Each front and middle slit opening 24A and 24C is preferably no wider than the width of the blade 14 of the arrow tip 16 behind which the opening 24A or 24C is longitudinally aligned on the arrow shaft 11. Each of the rear slit openings 24B is preferably no wider than the width of the fletch 20 behind which the opening 24B is longitudinally aligned on the arrow shaft 11. Also, it is preferable that the each opening 24A, 24B and 24C be no longer in length than approximately one quarter (¼ ) of an inch.

The particular alignments of the openings 24A, 24B, and 24C serve to made the arrow 10 more aerodynamic, allow the arrow 10 to be shot in a more accurate trajectory, and reduce the noise created as the arrow 10 flies through the air upon being released from the bow.

Although the arrow 10 has been described as having only three sets of openings 24A, 24B and 24C provided in the shaft 11, the invention is not so limited and additional openings may be provided on the shaft 11 as needed to effectively drain blood from the animal more quickly.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A bleed out arrow comprising:

a hollow arrow shaft having a first end and an opposite second end, an arrow tip with blades provided on the first end of the shaft and fletches provided on the second end of the shaft, front openings provided in the first end of the shaft being in fluid communication with a hollow interior of the shaft, the front openings located behind and aligned longitudinally with the blades of the arrow tip, and rear openings provided in the second end of the shaft being in fluid communication with the hollow interior of the shaft, the rear openings located behind and aligned longitudinally with the fletches.

2. A bleed out arrow according to claim 1 further comprising:

middle openings provided in the arrow between the first and second ends of the arrow being in fluid communication with the hollow interior of the shaft, the middle openings located behind and aligned longitudinally with the blades of the arrow tip.

3. A bleed out arrow according to claim 2 wherein the front openings are longitudinal slits.

4. A bleed out arrow according to claim 3 wherein the rear openings are longitudinal slits.

5. A bleed out arrow according to claim 2 wherein the middle openings are longitudinal slits.

6. A bleed out arrow according to claim 5 wherein the front openings and the rear openings are longitudinal slits.

* * * * *